United States Patent [19]

Cromarty

[11] 4,304,406

[45] Dec. 8, 1981

[54] GOLF TRAINING AND PRACTICE APPARATUS

[76] Inventor: John I. Cromarty, 505 Main St., Old Saybrook, Conn. 06475

[21] Appl. No.: 123,767

[22] Filed: Feb. 22, 1980

[51] Int. Cl.[3] ..... A63B 69/36

[52] U.S. Cl. ..... 273/186 R; 273/187 R; 273/DIG. 28

[58] Field of Search ..... 273/186 R, 186 RA, 186 A, 273/185 D, DIG. 28

[56] References Cited

U.S. PATENT DOCUMENTS

| | | | |
|---|---|---|---|
| 3,173,348 | 3/1965 | Betinis | 273/186 R X |
| 3,601,408 | 8/1971 | Wright | 273/185 D X |
| 3,717,857 | 2/1973 | Evans | 273/186 A |
| 3,945,646 | 3/1976 | Hammond | 273/186 A |
| 4,180,270 | 12/1979 | Long | 273/186 R |

*Primary Examiner*—George J. Marlo

*Attorney, Agent, or Firm*—Willard W. Roberts

[57] ABSTRACT

A golf training and practice apparatus has a television display and a plurality of sensors for sensing positions of a head of a golf club during the swing at a ball at a given location. A circuit responsive to the times of positioning of the head with respect to the sensors provides output signals to enable display on the television display of a graphic representation of the direction of the swing. The circuit also enables alphanumeric display of other parameters of the swing, and provides on the television display a fixed image of the angle of the face of the club at a time just before the ball reaches the ball position location. In order to also provide information relating to the golfer's stance, the apparatus includes sensors for indicating in alphanumeric characters the relative weight on each of the golfer's feet during various portions of the swing.

9 Claims, 7 Drawing Figures

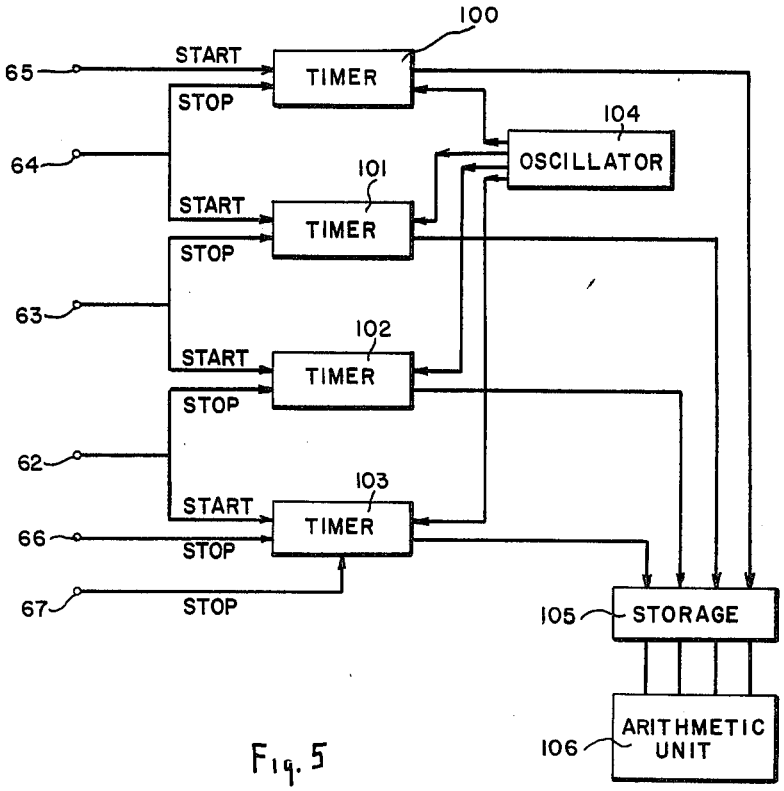
Fig. 5
Fig. 6
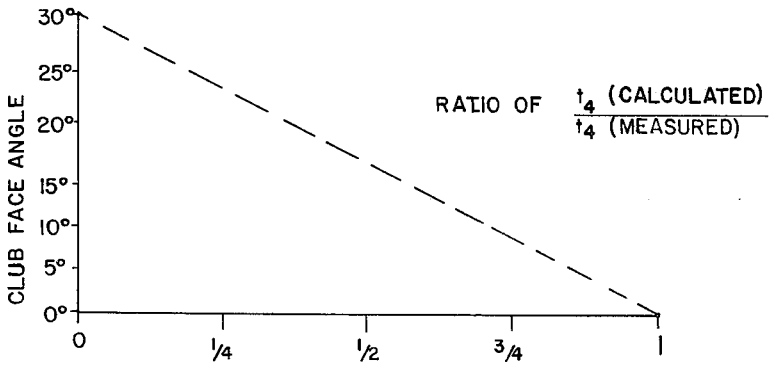

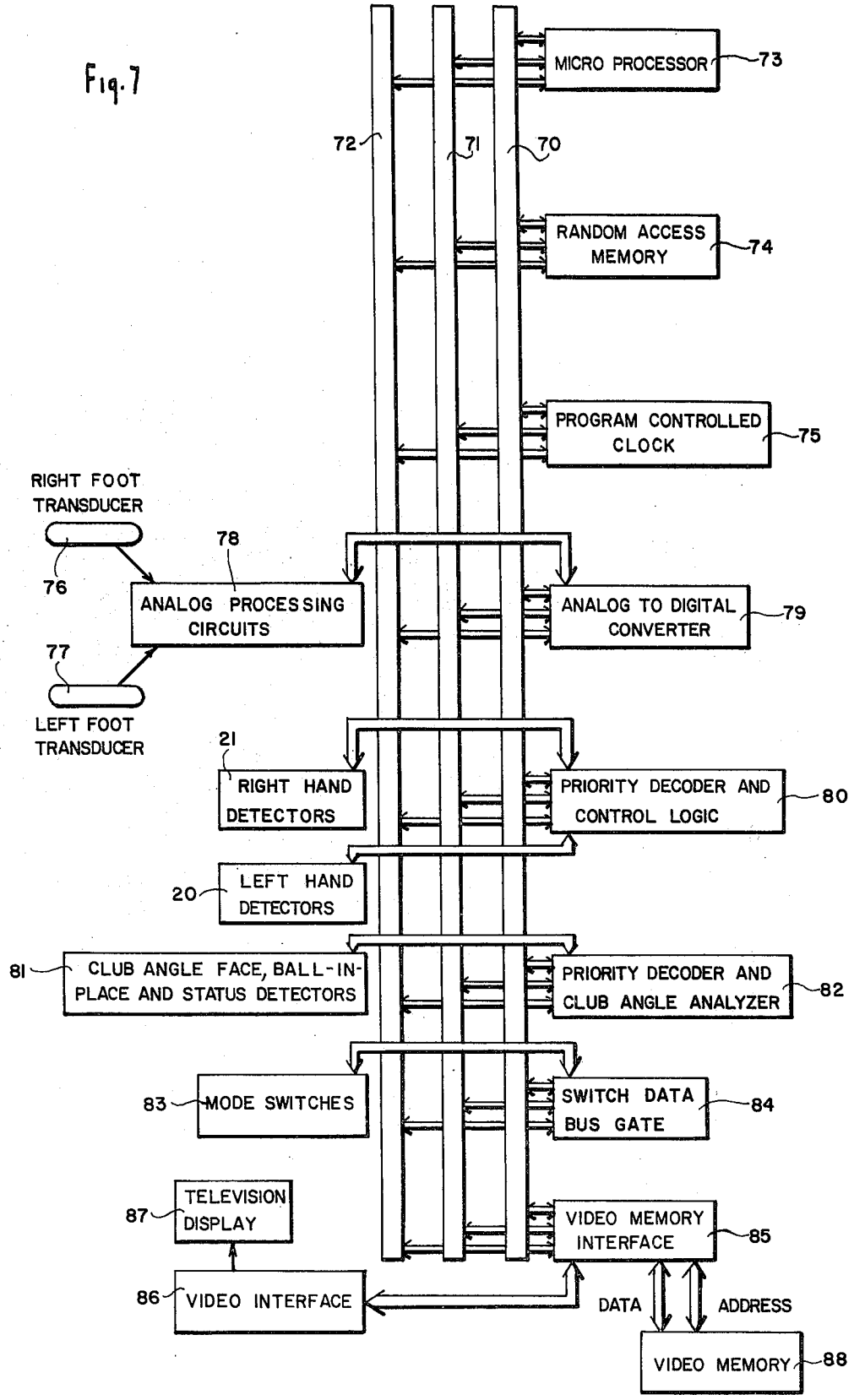
Fig. 7
MICRO PROCESSOR
73
72
71
70
RANDOM ACCESS MEMORY
74
PROGRAM CONTROLLED CLOCK
75
RIGHT FOOT TRANSDUCER
76
78
ANALOG PROCESSING CIRCUITS
ANALOG TO DIGITAL CONVERTER
79
77
LEFT FOOT TRANSDUCER
21
RIGHT HAND DETECTORS
PRIORITY DECODER AND CONTROL LOGIC
80
20
LEFT HAND DETECTORS
81
CLUB ANGLE FACE, BALL-IN-PLACE AND STATUS DETECTORS
PRIORITY DECODER AND CLUB ANGLE ANALYZER
82
83
MODE SWITCHES
SWITCH DATA BUS GATE
84
87
TELEVISION DISPLAY
VIDEO MEMORY INTERFACE
85
86
VIDEO INTERFACE
DATA
ADDRESS
VIDEO MEMORY
88

GOLF TRAINING AND PRACTICE APPARATUS

BACKGROUND OF THE INVENTION

This invention relates to a golf training and practice apparatus, and more in particular to an apparatus of the type providing a display enabling a person to improve or maintain constant the swing of a golf club.

In the past, many systems have been disclosed intended to train a person to properly swing a golf club, or to maintain a golf club swing with constant characteristics. Such devices, in their various forms, include platforms having various sensors thereon, so that a user may stand on the platform and swing a conventional or special golf club, depending on the system, at a real or simulated golf ball, again depending upon the system. The various sensors employed produced signals corresponding, for example, to the positions of the golf club head, and the relative weight on the feet of the user during the various portions of the swing. Such devices further provided various displays, to enable the user to ascertain various characteristics of the swing.

In such apparatus, the displayed data has been found to not be adequate to enable a user to improve the golf club swing to the optimum extent, either because of the lack of adequate information, the inaccuracy of the derived information, or the absence of the provision of a display that presented the data in a form adapted to readily enable the attaining of determined swing characteristics by a trainee or the maintaining of desired swing characteristics by an experienced player.

BRIEF SUMMARY OF THE INVENTION

The present invention is therefore directed to the provision of an apparatus adapted to overcome the aforestated disadvantages of known devices.

BRIEF FIGURE DESCRIPTION

In order that the invention will be more clearly understood, it will now be disclosed in greater detail, with reference to the accompanying drawings, wherein:

FIG. 5 is a simplified block diagram of a portion of the system;

FIG. 6 is a graph illustrating the calculation of club face angle; and

FIG. 7 is a block diagram of one embodiment of a system in accordance with the invention.

DETAILED DISCLOSURE OF THE INVENTION

Figure 1:
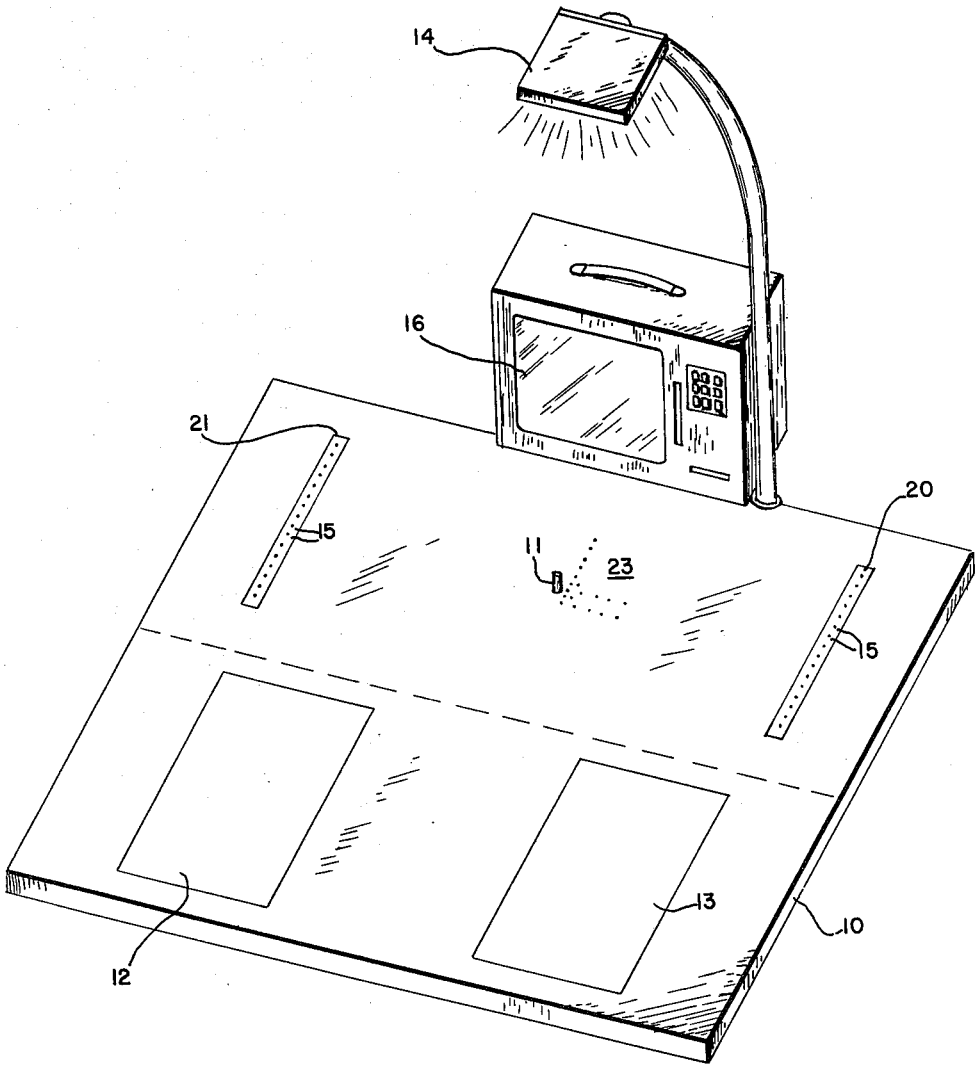
FIG. 1 is a simplified perspective view of a golf training and practice apparatus in accordance with the invention.

Referring to FIG. 1, therein is illustrated, in simplified form, a golf training apparatus in accordance with the invention. The apparatus comprises a platform of sufficient size so that a person can stand thereon, and swing a golf club. The platform is provided generally centrally with a location 11 for placing a golf ball, for example, on a tee. The golf ball may be of conventional type, or it may be a practice ball.

The platform 10 is further provided with a pair of weight pads 12 and 13 positioned such that a person using the apparatus will have his left and right feet, respectively, thereon, when making a normal swing at a ball at the location 11. The weight pads, as will be explained in greater detail in the following paragraphs, provide output signals corresponding to the weight placed thereon by the user of the apparatus. In addition, a plurality of sensors, such as infrared sensors are positioned in the platform 10, in order to provide signals when the head of a golf club is in proximity thereof. For this purpose the apparatus may be provided with a source 14 of infrared radiation directed downwardly onto the platform, whereby a golf club head, in passing over any of the sensors, will throw a shadow on such sensors to produce an electrical signal. The sensors 15 are disposed on the platform 10 in a determined pattern, in order to be able to detect the positioning and movement of the golf club head during a swing, such that all of the necessary parameters may be sensed and recorded, for the purpose of providing a useful display on an indicator 16. The indicator 16 may advantageously be placed within the view of the user, for example, at or adjacent the edge of the platform 10 that the user faces during a normal swing. The source 14 is permanently mounted, with respect to the platform, so that it is out of the way of the swing, while illuminating each of the sensors 15.

It is of course understood that the use of infrared sensors 15 and an infrared source constitutes the preferred embodiment of the invention, although any other suitable form of sensing device for sensing the position of the golf club head may alternatively be employed.

The indicator 16 is preferably in the form of a television screen, so that the presentation of alpha-numeric and graphic information can be presented to the user, to provide the most advantageous display for training or practice. The indicator 16 is advantageously portable, although this is not an absolute necessity for the purposes of the invention. Similarly, the platform may be advantageously also portable. It is important however, to provide a suitable mounting for the source 14 of infrared radiation, or the like, such that signals from the sensors may be accurately reproduced.

Referring still to FIG. 1, in the preferred embodiment of the invention a row 20 of sensors, for example, 20 sensors, is provided at the right hand side of the platform 10, and another row 21 of sensors is provided at the left side of the platform (considering a configuration of sensors for a right handed person). These two rows 20 and 21 are parallel, and extend in the direction that the user faces. In other words, the rows 20 and 21 extend normal to a target line shown generally by the reference numeral 22 (see figure), that passes through the location 11, and may or may not be parallel to the line joining the toes of the feet of the user. A sufficient number of the sensors is provided in each of the rows, so that at least one of the sensors in the row 20 will have a shadow cast thereon by the golf club head during a back swing movement and the downswing movement before impact, and at least one of the sensors of the row 21 will be shadowed as the club head passes thereby following the impact with the ball.

In addition, a plurality of further sensors are provided in the central region 23 of the platform, in order to enable the sensing of golf club head positions and speeds in this region, in a manner that will be discussed in the following paragraphs, in greater detail.

Figure 2:
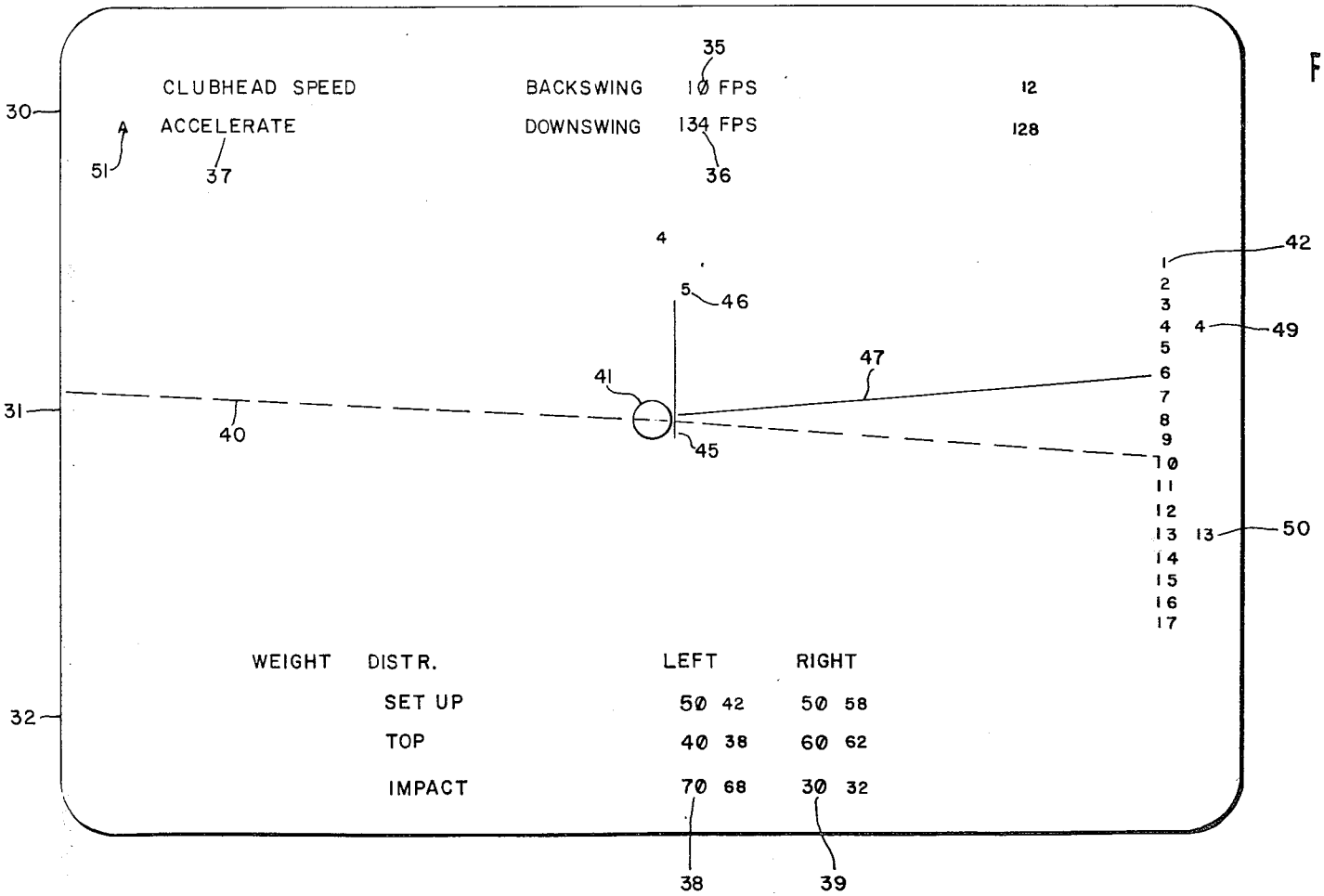
FIG. 2 is a view illustrating a typical display on a display device, in accordance with the invention.

The concept of the invention will be better understood by reference to FIG. 2, which illustrates a preferred form of display in accordance with the invention. The display conveniently has an upper portion 30 which contains alpha-numeric information, a central portion 31 which includes graphic information to more clearly show the operator the form of the preceding swing, and a lower portion 32 providing further alphanumeric information for the benefit of the user. It must be stressed that the invention is directed to the training and practice of the user in attaining constancy of the swing, since optimum swings for different people will not necessarily be the same. Thus, under the guidance of a pro, certain desired parameters of a swing will be set for a given user of the apparatus, and the user will thereby seek to constantly swing the golf club in accordance with the "design" swing. Corrections in the design swing may of course be made, in order to obtain the desired results, i.e., so that the golf ball will follow the desired course. It is of most importance, however, that the user be able to maintain the parameters of his swing constant and in accordance with the determined design swing.

As an example, at an initial training session a pro may observe the parameters of the swing of a trainee, and the results of the swing in terms of the direction, distance, etc., that the ball travels. Based upon this information the pro may set "design" parameters of a swing, which the trainee should seek to attain for every swing. Adjustments may be made in the "design" parameters, as time passes, in order to obtain further improvement. The setting of the "design" parameters is based upon the knowledge of the pro in determining variations in the swing necessary for the trainee to improve his swing.

In addition, the invention may be employed by more experienced persons, since it will enable them to detect variations in their own "design" swing that may have resulted in departures of the golf ball from the desired path. Such a user will thereby be enabled to determine the cause of the error, and to correct it by properly swinging the club to obtain the "design" parameters.

The apparatus in accordance with the invention is thereby arranged to enable the display of the parameters of the golf swing, in such a manner that the user will immediately be aware of departure of the swing from design parameters, and will hence be able to correct the swing so that constant swing parameters may eventually be obtained.

As shown in FIG. 2, the upper portion of the display has the fixed indicia "club head speed", "back swing fps" and "downswing fps". During the course of a swing, the sensors on the platform accumulate data to enable the calculation of the velocity of the club head during the backswing, and the velocity of the club head during the downswing, so that this data may be shown, as indicated at the reference numerals 35, 36. Further, the sensors provide sufficient data to enable determination of whether the club head speed was accelerating, decelerating, or constant, at the time of impact with the ball. This effect may be presented, for example, by displaying the word "accelerate" below the indicia "club head speed", as indicated by the reference numeral 37.

As shown in the lower portion of the display of FIG. 2, the fixed indica "weight distr.", "left" and "right" are provided, with rows for "set up", "top" and "impact", to enable a user to see the weight distribution of his feet during the set up time, at the top of the swing and at the time of impact of the club head with the ball. For this purpose, the weight pads 12 and 13 shown in FIG. 1 provide weight data, so that, at the various instants, the relative weight distribution, in percentage, between the two feet, can be determined and displayed, as shown by the numbers in the columns 38 and 39. Thus, the weight distribution at the set up time may be detected while the user is addressing the ball, prior to moving the club head backward during the back swing. The instant the club head uncovers the final address sensors, the set up weight distribution is locked in and displayed on the TV screen. The instant at the top of the swing may be reasonably indicated by the attaining of the maximum weight at the right foot (or the minimum weight at the left foot). At this time the weight distribution is locked in and displayed on the TV screen. The weight distribution at the time of impact may be determined by a sensor immediately adjacent the ball location, as will be discussed in greater detail in the following paragraphs. At this time also, the weight distribution is locked in and displayed on the TV screen.

In addition, a line 47 is displayed to the right of the ball location, this line indicating graphically the path of the golf club head during the backswing, with respect to the numbers 1–17 of column 42.

The actual direction of the backswing and downswing are thus displayed in the central portion of the display. Numerals 49 and 50 may be displayed adjacent corresponding numerals of the column 42, to indicate assigned "design" parameters for the direction of movement of the club head during the backswing and downswing respectively. Thus, with respect to the downswing, the numerals 1–9 correspond to an outside-in swing, and the numerals 9–17 correspond to an inside-out swing. These "design" parameter numbers may be externally set or changed by an operator or teacher.

The central portion 31 of the display shows a dashed line 40 depicting the direction of passage of the club head during a downswing with respect to the central position indicator 41 representing the ball location 11 of FIG. 1. In addition, a column 42 of numbers, for example, from 1 through 17, is provided, equally spaced apart, at the right edge of the screen. This indicia is a part of the fixed display, the line 40 indicating graphically the path of the golf club head with respect to this indicia. The numerals in the column 42 indicate the departure of the swing from the target direction.

The central portion 31 of the display further shows a line 45 adjacent the ball location 41, the line 45 having an inclination, corresponding to the club face attitude. As will be discussed, such information can be derived from the sensors in the region 23 of the platform, as shown in FIG. 1. A small numeral 46 is further displayed, for example, adjacent the top of the line 45, this numeral representing the club face attitude, for example, in a scale of 1–9. For example, the numeral 1 may represent a completely closed angle, and the numeral 9 may represent a completely open angle, with the intermediate numbers of course corresponding to intermediate angles as displayed by line 45.

As a further aid in training and practice, smaller sized numerals may also be displayed on the screen for showing further assigned "design" parameters, thereby showing the user the desired parameters. Thus, the club head speed condition may be indicated by an alphabetic character 51, and the other externally settable "design"

parameters are indicated by the smaller numerals adjacent the corresponding measured parameters.

It will of course be understood that the various data may be arranged differently on the screen and that, if desired, the display may be colored, as in a color television system, to enhance the use of the system.

Figure 3:
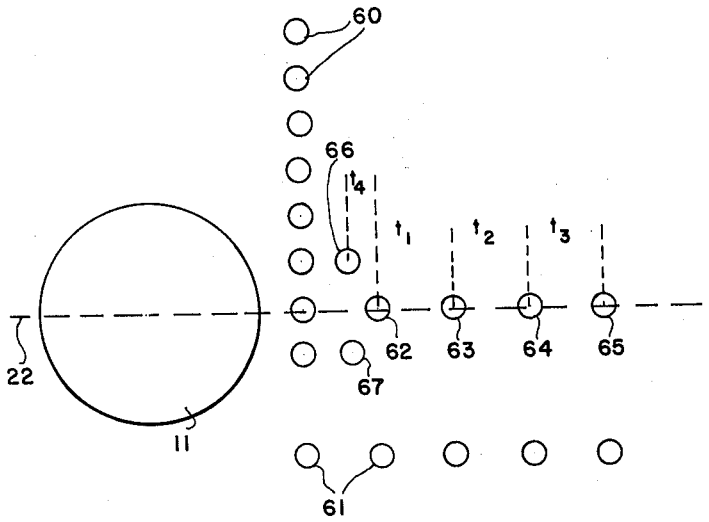
FIG. 3 is an illustration showing the positioning of sensors adjacent the ball position, in the system of FIG. 1.

FIG. 3 more clearly illustrates the position of the sensors in the region 23 immediately to the right of the ball location 11. As illustrated, a column of sensors 60, for example, 8 sensors, is provided on a line of, for example, 0.25 inches to the right of the ball position 11. These sensors may be, for example, about 0.3 inches apart, with 6 of the sensors being above the center line 22 (i.e., away from the user), one of the sensors falling on the line 22, and one falling below the line 22. These sensors are positioned to provide information regarding the club face position, i.e., the location of the ends of the club face at the time just before impact, in order to provide data for the presentation of the line 47 of FIG. 2.

A row of sensors 61, of 1 to 10 sensors (5 being shown in the drawing) is provided extending toward the right, preferably from a position about $\frac{1}{4}$ inch to the right of the ball position 11 and an inch below the line 22. These sensors 61 may be, for example, $\frac{1}{2}$ inch apart, and are referred to herein as final address sensors, since they will produce signals which may be interpreted to indicate the start of a backswing, for example, as the club head moves successfully toward the right.

A further row of sensors 62, 63, 64 and 65 is provided on the line 22, extending toward the right in that order from a position at about $\frac{3}{4}$ inch from the ball position 11 (i.e., in line with the next to lowest sensor 60). These sensors are also positioned, preferably, about $\frac{1}{2}$ inch apart. These sensors enable a determination of whether the club head is accelerating, decelerating or is at a constant velocity, depending upon the relative time at which the club head shadows the sensors during a downswing. Thus, if the time $t_1$ is greater than the time $t_2$ is greater than the time $t_3$, the club head is decelerating, wherein the times $t_1$, $t_2$ and $t_3$ correspond to the delays of signals between the sensors 62 and 63, 63 and 64, and 64 and 65, respectively.

The determination of club face attitude or angle is somewhat more complex, since a determination of this parameter cannot directly be made from the sensors unless a very large number of sensors is employed to monitor the shadow of the club head. In accordance with the invention, this problem is solved with the provision of a pair of sensors 66 and 67 in a column to the left of the sensor 62, the sensors 66 and 67 being for example, 0.3 inches above and below the target direction line 22 respectively. The line between the sensor 62 and each of the sensors 66 and 67 is about 60 degrees, with respect to the target direction line 22, although it is apparent that this angle may vary.

Figure 4:
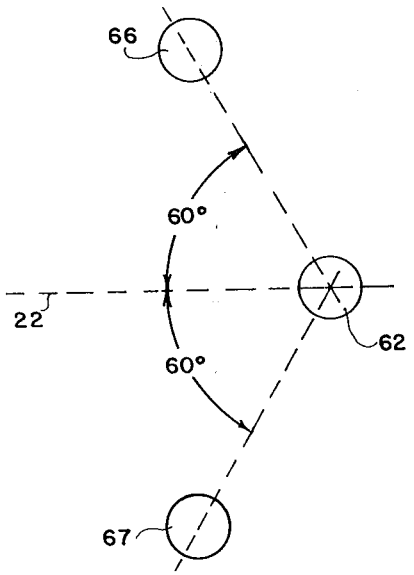
FIG. 4 is an enlarged view of a portion of the arrangement of FIG. 3, more clearly illustrating the position of determined sensors.

This relationship is seen more clearly in FIG. 4. The time between which the shadow of the club head passes the sensor 62 and the time the club head passes one of the sensors 66 or 67 is designated $t_4$. If the club head shadow strikes the sensor 66 before the sensor 67, then the club is closed. Alternatively, if the signal is obtained from the sensor 67 before the signal from sensor 66, then the club head is open. The determination of which of the sensors 66 or 67 has been activated to produce a signal first may be achieved in a simple manner by noting the condition of the signal from the final address sensor 61 at the left end of this row of sensors. It is of course apparent that a valid signal can be received with respect to the club face angle only if the angle is less than the above noted angular disposition of the sensors.

If only the time $t_4$ were available, then it is apparent that the club face angle could not be determined. In other words, although variation in club face angle will result in a variation of the time $t_4$, assuming all other factors remain the same, it is apparent that the velocity of the club head may not in fact be constant for different swings. As a result, in order for the time $t_4$ to represent a meaningful value corresponding to the club face angle, it is necessary to normalize this time by the time $t_{178}$ (i.e., a velocity function). This normalization may be calculated by the computer employed in the system. Upon such normalization, a simple linear relationship then may exist between the time $t_4$ and the club face angle.

In accordance with the invention, it has been found that the only practical method for measuring the angle of the club face of a rapidly moving club head, independently of the club head speed ane exact position of the club head, requires a special arrangement of 6 detectors. A lesser number of detectors than this does not provide the necessary capability of accuracy and independence of the club head speed variable and the coordinate position variable. Although more detectors can be employed, such additional detectors are not necessary, and do not provide additional data that would materially increase the accuracy of the measurement. The necessary 6 detectors are the detectors 62–67 as above described.

As an example, consider the club head, in a downswing, approaching the ball from the right as illustrated in FIG. 3. The time of passage of the club head by each of the sensors results in separate input data bits to the computer of the system, the computer constantly scanning and analyzing the sensor input information. As the club head interrupts the sensor 65, the computer begins to time the club head speed by controlling a first interval timer 100, as illustrated in FIG. 5. As the club head interrupts the second sensor 64, the computer stops the interval timer 100 and starts a second interval timer 101. As the club head interrupts the third sensor 63, the output of this sensor stops the interval timer 101 and starts a further interval timer 102. Still further, as the club head passes the sensor 62, the output signal from the sensor effects the stopping of the timer 102 and the starting of interval timer 103. When the club head passes either of the sensors 66 or 67, the resultant output signal effects the stopping of the timer 103. The resultant intervals determined by the timers 100 to 103, which correspond to the times $t_3$, $t_2$, $t_1$ and $t_4$ respectively, are stored in the computer for determining the acceleration of the club head as well as the club face attitude.

Theoretically, the club face angle could be plus or minus 30 degrees or greater at the moment the sensor 62 is interrupted, but the computer programming sequence is preferably arranged such that the next numbered cycle will immediately stop the timer 103 allowing a small (minimum) numeric value to be recorded from the timer 103. The oscillator, in the computer, for driving the interval timers 100–103, is selected to provide a sufficient rate in order to enable the accurate counting of intervals for very fast and relatively slow golf swings.

A short interval after the club head interrupts the sensors 66 or 67, the club head will impact the ball at the position 11, and will also cover several of the sensors 60. If the club head covers a determined group of these sensors 60, for example the lower 6 sensors of this group, and simultaneously covers the leftmost final address sensor 61, regardless of the angle of the club face, the club head will have impacted the ball on the "sweet spot" of the club face. The sensors are acoordingly positioned to meet this condition. If, on the other hand, the upper sensors of the row 60 are covered during the swing, and the lower sensors of this row are uncovered, then it will be an indication that the club head has impacted the ball on or toward the "heel" of the club face. The inverse condition of sensor coverage indicates that the club head must have passed the ball on or toward the "toe" of the club face. The computer can very closely approximate the time of impact and collect data at impact from the sensors of the row 60, so that the face position can be established with an accuracy meaningful to an operator. Thus, the indicated display data can be accurate to within about ½ inch.

Returning now to the determination of the club face angle, the timers 100, 101 and 102 provide data corresponding to the time intervals $t_3$, $t_2$ and $t_1$ respectively. The outputs of these timers are data signals corresponding to the respective times. If, in the program of the computer, it is determined that the time intervals are all equal to one another, then it is apparent that the club head speed is constant. Assuming that the club face angle is 0 degrees, the calculated interval $t_4$ will be equal to $t_1$ divided by 2. The deviation of the measured interval $t_4$ from the calculated value will vary, linearly, with the club face angle. On the other hand, if $t_3$ is greater than $t_2$ is greater than $t_1$, then the club head speed is decelerating, and, by approximation, the calculated value of $t_4$ will be equal to $[(t_3+t_2+t_1)/3]/2$. Likewise, if $t_3$ is less than $t_2$ is less than $t_1$, then the club head will be accelerating and, by approximation, the calculated value of $t_4$ for a 0 club face angle will be $[(t_3+t_2+t_1)/3]/2$. As a consequence, it is possible to determine the accuracy of $t_4$ to a few percents. Since the club head speed varies linearly and involves little change, the relationship of the club face angle to the calculated value of $t_4$ is also linear so that the club face angle can be obtained from calculations in accordance with the graph illustrated in FIG. 6. The arrangement in accordance with the invention thereby normalizes the time $t_4$ with respect to the velocity of the club head, in order that the measured time $t_4$ can be a linear function of the club face angle. If the calculated value of $t_4$ is equal to the measured value the club face angle will thus be indicated to be 0. The computer is thus arranged (programmed) to solve the equation:

$$\text{club face angle} = -30^\circ t_4(\text{measured})/t_4(\text{calculated}) + 30^\circ.$$

The ultimate accuracy of the indicated club face angle depends upon the oscillator frequency and the club control during the down swing. As illustrated diagrammatically in FIG. 5, the timers 100–103 are thus controlled, for example, by an oscillator 104, whereby the outputs of the oscillators correspond to counted numbers of cycles of operation. The data output of the timers is applied to a memory 105 for later use by the arithmetic unit 106 in the determination of the club face angle and state of acceleration, as above discussed.

In the calculation of the weights on the weight pads, analog devices such as load cells may be provided under each pad for producing analog output values corresponding to weight. These values may be converted by conventional analog to digital converters to provide weight data to apply to the computer. The computer thereby need only calculate the relative weight at the determined instant of the swing, on a percentage base, for display.

The club head speed during the backswing may be determined by a further interval timer which is connected to start when the club head uncovers the right hand most sensor of the final address sensors 61. The timer being stopped upon the next subsequent uncovering of a timer of the column of timers 20. The back swing speed is therefore calculated on the basis of the distance between the corresponding sensors, and the measured time interval. The downswing velocity may be determined by a further timer set to start at the instant of covering of any of the sensors 20 during the downswing, the timer being stopped by the covering of any of the sensors of the row 21. The velocity calculated is thus the average velocity calculated as a function of the distance between the related sensors and the measured time intervals.

Referring now to FIG. 7, therein is illustrated a block diagram of a preferred mode of the invention. This figure illustrates a microprocessor system having a data bus 70, address bus 71 and control bus 72. A microprocessor circuit 73 is connected to all of the buses in the conventional manner. For example, the microprocessor circuit may employ a conventional 8080A microprocessor chip, or any other conventional microprocessor chip, connected in the normal manner to the buses.

In addition, the circuit of FIG. 7 includes a random access memory, 74, also connected in the conventional manner to each of the buses. In a preferred embodiment of the invention the random access memory employed 4044 type chips, to form an 8K byte static memory. The detected time information may be stored in the memory.

The system of FIG. 7 further includes a program clock circuit 75 connected to each of the buses, for example, employing a conventional 8253 chip system. This circuit may also include the oscillating circuits for the times, as well as the interval timers for determining the time periods above discussed.

The left and right weight pads 12 and 13 respectively of FIG. 1 control left foot and right foot transducers 76 and 77 respectively of FIG. 7, the outputs of these transducers being applied to an analog processing circuit 78 to provide analog signals corresponding to the relative weight applied to these two pads. These analog signals are then applied to analog to digital converter 79, which is in turn coupled to each of the buses. The converter circuit 79 includes address decoders, so that the data therefrom may be selectively applied to the data bus.

In addition, the infrared detectors of the left hand and right hand rows 21 and 20 respectively are coupled to a decoder and control logic circuit 80, which is also coupled to each of the buses. This decoder circuit also includes address decoders in the conventional manner, so that the data receiver thereby may be selectively applied in digital form of the data bus.

The sensors in the region 23 of the platform, as indicated by the block 81 in FIG. 7, are coupled to a decoder 82, which is also coupled to each of the buses. The decoder circuit 82 includes circuits for analyzing the club face angle and the club status, so that this data may be also selectively applied to the data bus.

In addition, a mode control circuit 83, including switches for selectively controlling the manner of operation of the system, is connected to a decoder circuit 84 connected to each of the buses, for selectively applying data to the data bus. The buses are also connected to a video memory interface 85, which controls a video interface 86, connected to the television display device 87. The video memory interface is coupled to a video memory 88, which may provide a storage of, for example, 8K bytes of random access memory and read only memory.

In the system of the invention, it is therefore apparent that the infrared detectors and control switches are sequentially polled by the microprocessor circuitry, to selectively apply data to the data bus. This data, after processing as above discussed, is applied to the video memory interface for the production of the final display on the device 87. The sequential polling and control of the system of this system is effected by the program stored in suitable read only memory devices in the microprocessor chip circuit 73.

The program control clock circuit 75 is employed, since it is necessary to record the times of activities of various occurrences in the process of a given cycle of the apparatus, in order to keep track of the various events. This programmable clock is connected to be started and stopped by the microprocessor in the conventional manner, depending upon conditions predetermined in the program or by conditions outside of the system, such as the motion of a golf club past the various sensors. The program controlled clock may, for example, include three clocks responsive to selective combinations of signals on the address line, in order to enable control of this portion of the system. As discussed above, this circuit is also of conventional structure.

In accordance with the invention, each of the sensing devices is coupled to a control circuit, such as the circuit 79, 80, 82 and 84, for the production of data signals corresponding to the status of the respective sensors. These signals, upon polling of the respective circuits, are applied to the data bus for temporary storage in the memory circuit 74. The program of the microprocessor processes this stored data, so that the required processed video data can be applied to the video memory interface 85 at selected times during the program. Such data may be stored in the video memory 88, in order to enable the continuous production of the television display. The circuit 86 may include suitable timing generators and color control circuitry, to enable the necessary control of the television display, in the conventional manner. The data processed by the microprocessor is also under the control of the program controlled clock 75, since the output of this circuit is also necessary in order to determine the time related functions.

In order to facilitate the use of the apparatus in the processes of teaching and practice each of the parameters displayed on the TV screen during a swing may be compared with design parameters, such as the indicia 46 and 49–51 illustrated in FIG. 2. These numbers are also variable, and are adapted to be set by a teacher or the operator. This may be affected in any conventional manner, such as, for example, by providing a keyboard (not shown) coupled to the television screen circuitry for introducing the desired design parameters in the display. The processing circuit for this arrangement is conventional. The operator of the equipment may thereby compare the assigned design parameters with the parameters of the actual swing, in order to be able to adjust the swings in the desired manner.

It must of course be stressed that the design parameters, in order to achieve the best results, are not fixed, and vary from player to player. The parameters may thus be dependent, for example, on the normal placement of feet on the weight pads. In order to be able to control this parameter, the apparatus may include adequate fixed indicia on the base to enable the user to consistently place his feet in the same position with respect to the ball position.

While the invention has been disclosed and described with reference to a single embodiment, it will be apparent that variations and modifications may be made therein, and it is therefore intended in the following claims to cover each such variation and modification as falls within the true spirit and scope of the invention.

What is claimed is:

1. In a golf training and practice apparatus having a ball position location, a plurality of sensors for producing signals in response to the proximity thereto of the head of a golf club, said sensors being positioned to sense positions of the head of the club at least during a portion of a swing of said club aimed at said ball position loction, an indicator, and a circuit for receiving said signals and controlling said indicator to provide a display of a characteristic of said swing; the improvement wherein said indicator comprises a television screen, means for producing a fixed graphic image on said screen of a ball position, said circuit further comprising means responsive to said signals for producing a graphic image on said screen of actual path of the club head with respect to said location during at least one portion of said swing.

2. The apparatus of claim 1 further comprising means for producing a fixed graphic image on said screen of the angle of the face of the club at a time just before the club reaches said ball position location.

3. The apparatus of claim 1 in which said fixed graphic image extends from one side of said screen towards said ball position, and further comprising means displaying a column of alphnumeric indicia extending along said one side of said screen as an aid in determining the angle of said swing.

4. The apparatus of claim 1 further comprising a pair of weight pads positioned to be stood upon during said swing, said weight pads having sensors, and further comprising means responsive to said last mentioned sensors for indicating in alphanumeric characters the weights on each said pad at a predetermined number of times during said swing.

5. The apparatus of claim 1 further comprising means for the displaying on said screen in alphanumeric characters: the club head speed, the back swing speed, the down swing speed, and the club face angle just prior to reaching said ball position location.

6. In a golf training apparatus having a ball position location, a plurality of sensors for producing signals in response to the proximity thereto of the head of a golf club, said sensors being positioned to sense positions of the head of the club at least during a portion of a swing of said club aimed at said ball position location, an indicator, and a circuit for receiving said signals and controlling said indicator to provide a display of a characteristic of said swing, the improvement wherein a plurality of said sensors are positioned to be sequentially passed by said club head during a down swing motion, said circuit comprising means responsive to said last-mentioned sensors for determining the downswing acceleration of said club head, said sensors further comprising a pair of sensors angularly disposed with respect to one of the sensors of said first mentioned group, to be passed by said club head following the passing of said one sensor, said circuit further comprising means responsive to the times of passage of said golf club with respect to said one sensor and said last-mentioned two sensors, and means normalizing said passage of sensors to the velocity of said club head for producing a data signal corresponding to the club face angle.

7. The apparatus of claim 6 wherein said plurality of sensors comprises at least three sensors arranged in a line intersecting said ball position location.

8. The apparatus of claim 7 further comprising a second plurality of sensors arranged in a line positioned to be crossed by said club head at a time just before reaching ball position location, for providing signals indicative of ball position of the club head.

9. The apparatus of claim 8 further comprising a third plurality of sensors arranged in a row for providing signals responsive to the addressing of a ball at said ball position location.

* * * * *